United States Patent [19]

Hood

[11] 4,267,790

[45] May 19, 1981

[54] SAIL FURLING AND REEFING APPARATUS

[76] Inventor: Ralph S. Hood, 2543 Lucille Dr., Fort Lauderdale, Fla. 33316

[21] Appl. No.: 898,290

[22] Filed: Apr. 20, 1978

[51] Int. Cl.[3] ..... B63H 9/10

[52] U.S. Cl. ..... 114/106; 114/90

[58] Field of Search ..... 114/39, 102, 103, 104, 114/105, 106, 107, 90, 112

[56] References Cited

U.S. PATENT DOCUMENTS

| | | | |
|---|---|---|---|
| 2,107,303 | 2/1938 | Ljungstrom | 114/106 |
| 3,285,215 | 11/1966 | Potter | 114/102 |
| 3,835,804 | 9/1974 | Jackson | 114/107 |
| 4,030,439 | 6/1977 | Hood et al. | 114/106 |
| 4,061,101 | 12/1977 | Cook | 114/106 |
| 4,090,461 | 5/1978 | Rusich | 114/90 X |
| 4,116,152 | 9/1978 | Larsson | 114/106 |
| 4,130,292 | 12/1978 | Lorenz | 114/39 X |
| 4,149,482 | 4/1979 | Hoyt | 114/106 |

*Primary Examiner*—Edward R. Kazenske

[57] ABSTRACT

Apparatus for supporting and furling a sail wherein a hollow mast having a chamber therein is provided with a slot leading into the chamber and a rotatable inner mast in the chamber arranged to bear the weight of the sail in compression. Rotating the inner mast furls the sail. The inner mast is also relatively rigid against torsional bending, its diameter is relatively large. The width of the slot is also relatively large and contoured so that the sail slides freely through the slot even though wrinkled. As a result, the sail can employ adequate fullness, and risk of jamming while furling is minimized.

7 Claims, 8 Drawing Figures

FIG. 2
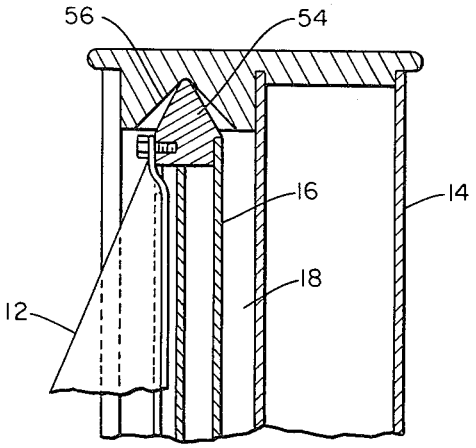
FIG. 3
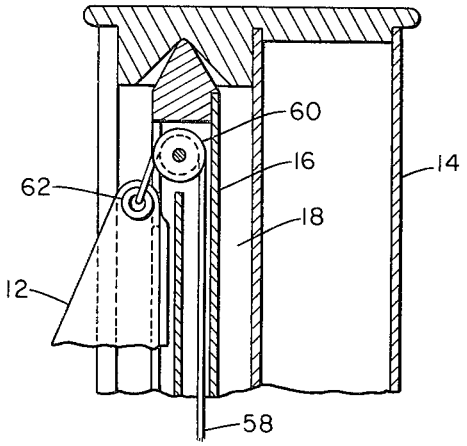
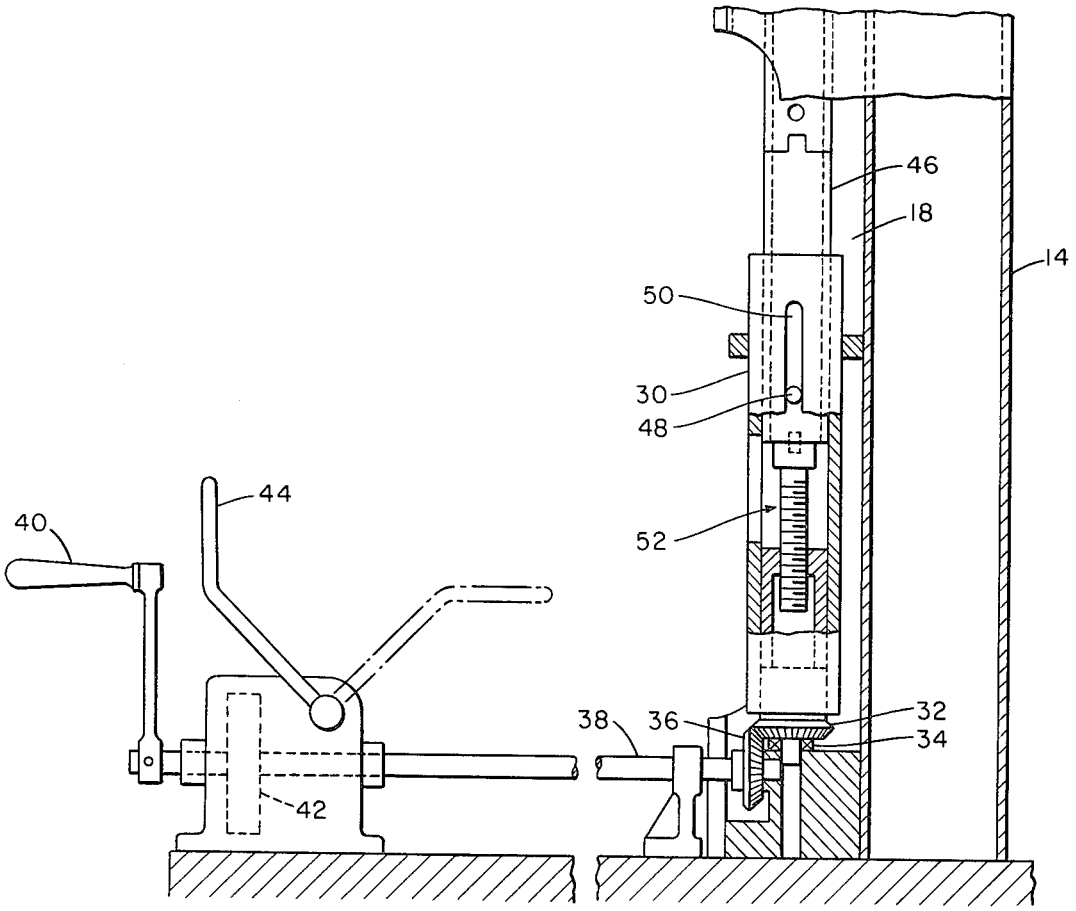
FIG. 4

SAIL FURLING AND REEFING APPARATUS

FIELD OF THE INVENTION

This invention relates to apparatus for supporting and furling sails of wind propelled vehicles.

BACKGROUND OF THE INVENTION

The problem of providing automatic furling for sailing vessels has long plagued the sailing industry. In recent year various improvements have been made. For example, head sails in fore-and-aft rigged ships are now being "roller reefed" or furled by mounting them on a cable which is adapted with swivels above and below the sail so that the sail can be wound up on the cable by rotating it. Main sails are also being "roller reefed" by mounting them on a rotatable boom. Furling or reefing is accomplished with these later equipments by rotating the boom while lowering the sail (see e.g. U.S. Pat. No. 3,285,215). For square sail rigged ships, an arrangement has been proposed for employing a slotted hollow mast and drawing the sail into the hollow by winding it up on a rotatable cylindrical tube located within the mast (see U.S. Pat. No. 3,483,840). It has also been suggested that reefing or furling can be done in small boats having unstayed masts, by rotating the mast (see U.S. Pat. No. 2,107,303). A recently developed form of reefing and furling of main sails comprises providing an aft-facing slot in a hollow mast, and securing the sail to a rotatable cable in the hollow within the mast which cable employs swivels at the peak and tack and is virtually identical to the rotatable cable described above for use with head sails.

These prior art uses and suggestions leave much to be desired. Roller reefing of head sails on a rotatable cable, although widely used, has problems. The cable is flexible and as a consequence it yields torsionally. This means that it is not well suited for reefing, i.e. sails while partly furled. This becomes more of a problem as the wind force and hence the need for it increases. Roller reefing of head sails is, therefore, best suited for completely furling, or in effect, storing the head sail.

Roller reefing of main sails (or similar sails abaft the main mast) on a rotating boom has other disadvantages. Since the sail must be wound up on the boom, the reinforcing cable on the luff of the sail (as well as the slides when applicable) must also be wound on the boom. This causes a bunching and increased diameter at the tack, and the sail is then drawn onto the boom unevenly and wrinkles, extending upwardly across the sail result. In addition, the reefing operation requires coordination between the rolling and the sail lowering steps, which coordination requires extra hands, and can be embarrassing especially in a critical moment when it suddenly becomes necessary to reef, a moment when the extra hands are most apt to be needed elsewhere.

The proposals of U.S. Pat. Nos. 2,107,303 and 3,483,840 mentioned above also involve a variety of disadvantages, but since they are not relevant to the type of rig of the present invention their disadvantages are likewise not relevant.

The reefing and furling of U.S. Pat. No. 3,835,804 is particularly relevant to the present invention because it involves drawing a fore-and-aft or Bermudian rigged main sail into a hollow mast which supports the luff of the sail. The arrangement of U.S. Pat. No. 3,835,804, however, has several significant draw-backs as follows. First, the rotating cable inside the mast, to which the luff of the sail is attached, must have freely rotating swivels at the top and bottom. Swivels operate well if they are properly oiled and maintained, but they can become fouled, clogged, or corroded. This is particularly a problem with the swivel at the peak, where maintenance is not easy. Another problem relates to the flexibility of the cable. It twists torsionally. This is accentuated not only when the peak swivel is sticking, but also when the wind force and hence the force needed to haul in the sail, increases. When the cable twists, the sail winds up more on the lower part than above and wrinkles appear as a result. Wrinkles are particularly vexatious with this rig because the aft-facing slot must be quite narrow in order to keep the sail from pulling the cable through the slot, and wrinkles tend to jam in the slot. Again, as the wind force increases, the sail pulls the cable toward the slot with greater force thereby offering greater resistance to winding, greater torsional bending and more wrinkles, at the critical moment of increased need for reefing—exactly when wrinkles and jamming are most vexatious. Another factor also causes wrinkling. Most main sails are cut with a roach along the luff to provide "fullness" for the sail. Generally speaking more fullness is desired for light air, whereas flatter sails are desired for heavy air. It is usual, however, to provide an average fullness, so that the sail will be useful for a wide range of wind forces. When such a sail is being reefed or furled with the arrangement of U.S. Pat. No. 3,835,804, since the rotating cable is relatively straight and the sail luff is curved, there is no place for the extra material to go. It simply wrinkles. As a result of these disadvantages of the arrangement of U.S. Pat. No. 3,835,804, the users are given elaborate instructions on how to cope with jamming of the sail in the slot involving emphasis on care for the maintenance of the swivels, techniques of heading into the wind to relieve tension on the sail together with repeated short cycles of furling and unfurling to loosen jams. Another recommendation is to have the sails cut very flat. Cutting the sails flat, of course, helps avoid wrinkles, but is not good for sailing efficiency.

SUMMARY OF THE INVENTION

The object of the present invention is to provide apparatus for reefing and furling sails in fore-and-aft rigged ships (or boats) which can be operated from a remote point by a single person, and which avoids or minimizes the risk of complications and prevents jamming as the wind force increases.

In the accomplishment of these objectives in a preferred embodiment, a hollow mast is employed having an aft-facing slot which provides access into the interior of the mast. Inside the mast there is a cylindrical rotatable inner mast to which the luff of the sail is attached. The inner mast is supported against downward longitudinal forces only at its base and takes the full weight of the sail in compression. The sail is either secured to the top of the inner mast, or it is hauled up the inner mast by means of a halyard (and sheave at the top of the inner mast) which returns down on the inside of the inner mast. The top of the inner mast is conical and it fits into a conical matrix at the top of the main mast whereby the top of the inner mast is centered in the mast cavity at the top. Thus, it is a feature of the invention that no swivels are required for the top of the inner mast.

Although the inner mast is essentially rigid longitudinally, it will bend slightly laterally. This brings it into contact with the cavity walls along the middle height of the mast. The inner mast has a relatively large diameter and likewise the aft-facing slot, although it is substantially smaller in cross section than the outside diameter of the inner mast, it still has a relatively wide opening, that is, wide enough so that there is virtually no risk of the sail jamming therein due to wrinkles.

The larger diameter and rigidity of the inner mast reduces tortional twisting to insignificance such that wrinkles due thereto are virtually non-existent. In addition the bearing surfaces between the mast cavity walls and the inner mast along the middle height of the mast, whether in the furled, unfurled or reefed condition are broad and offer relatively little resistance to sliding.

In addition the sail is arranged so that when it is reefed, at the middle height of the mast, the sail contacts the lips of the slot only on one side (i.e. the port side) while sailing on the related tack (i.e. the starboard tack), but while on the opposite tack (i.e. the port tack) the sail does not contact the lip of the slot, but derives its luff-line from the tangent of the inner mast. In this way a large diameter inner mast may be used along with a wide slot opening without creating a significantly different drape to the sail while reefed.

The inner mast in one embodiment, is made up of sections interconnected with bayonnet joints. This permits the inner mast to be inserted or removed without either the use of a derrick or unstepping the mast.

Rotating the inner mast is done by means of a crank which can be located in the cockpit, the crank rotates a shaft which by means of mating bevel gears at the base of the mast rotates the inner mast. Both a hand brake and a centrifugal clutch-brake are arranged to prevent rapid unfurling.

DESCRIPTION OF THE DRAWINGS

Preferred embodiments of the present invention are shown in the accompanying drawings in which:

FIG. 2 is a cross-sectional view of the mast head bisected on the vertical fore-and-aft plane;

FIG. 3 is a cross-sectional view of the mast head as in FIG. 2, showing an alternative way to support the sail.

FIG. 4 is a view in side elevation of the base of the mast with a portion broken away to show the means for adjusting the height of the inner mast;

DETAILED DESCRIPTION OF THE INVENTION

Figure 1:
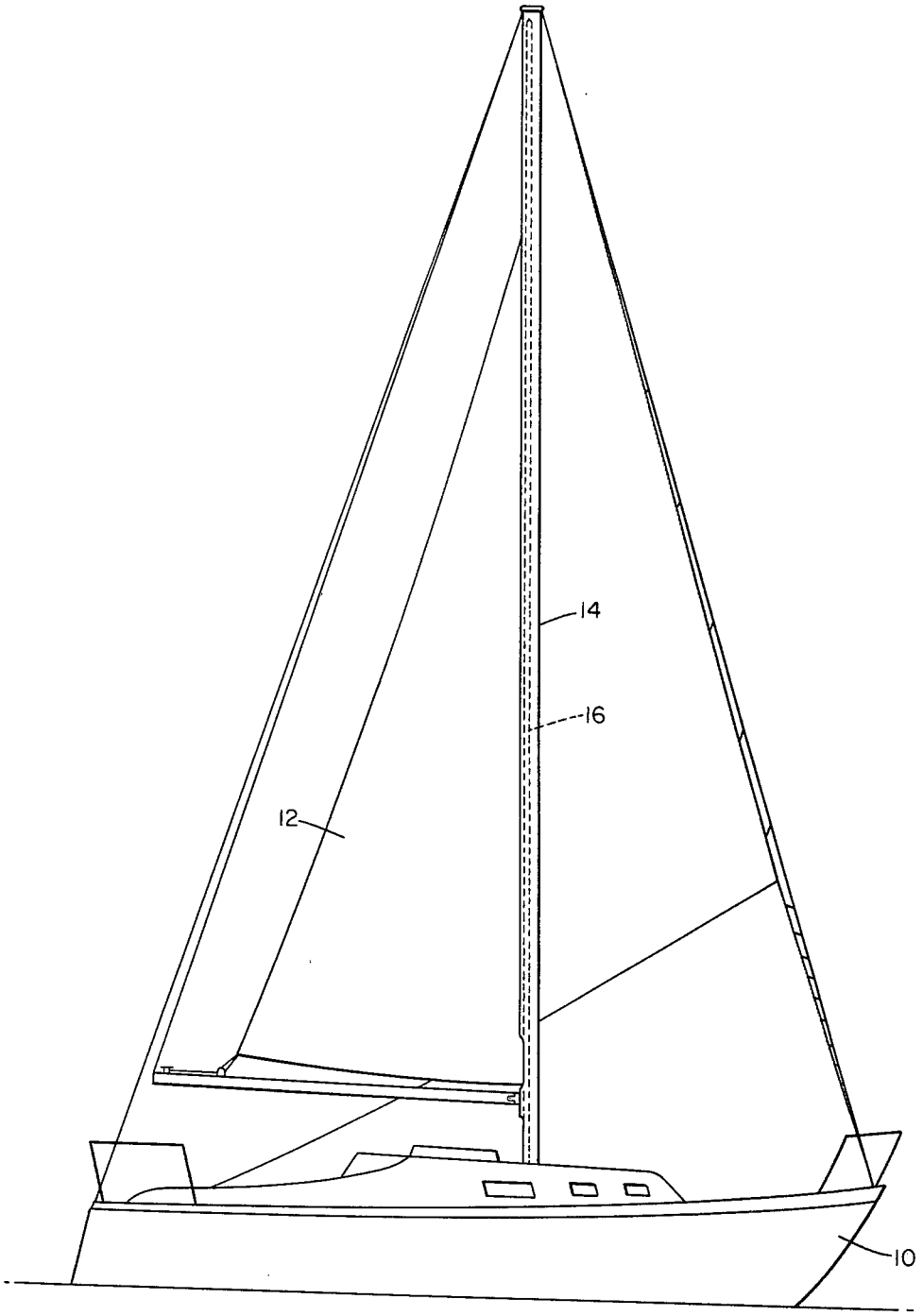
FIG. 1 is a view in side elevation of a sail boat employing the furling apparatus, showing the sail in the partly reefed position.

The preferred embodiment of the invention herein shown is suitable for use in a typical cruising boat 10, to reef or furl a sail 12 shown partly furled in FIG. 1.

Figure 7:
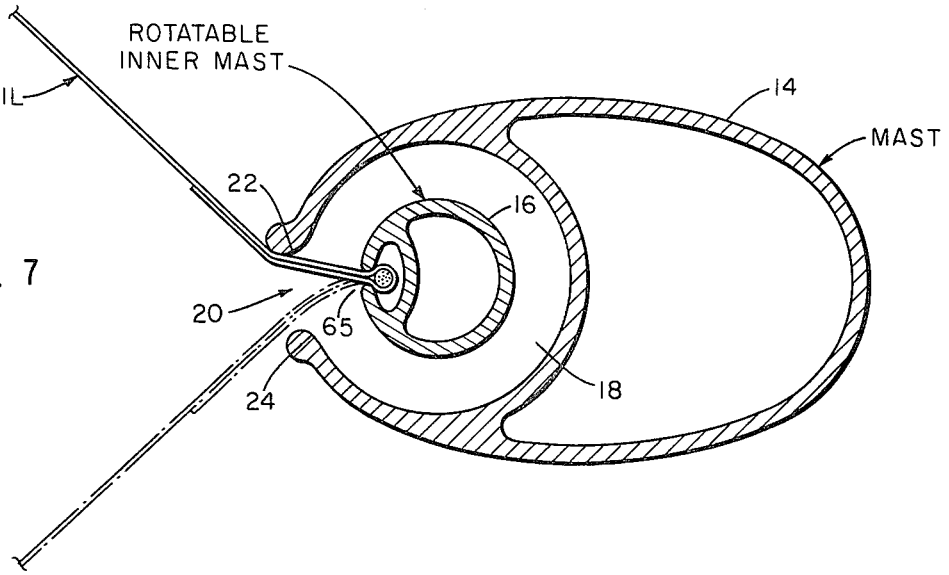
FIG. 7 is a plan view in cross-section of the mast, and inner mast.

The principal components comprise a mast 14 and an inner mast 16 which may suitably be aluminum extrusions, the cross-sections of which are shown in an enlarged view in FIGS. 7 and 9. Typically these extrusions are made from 6061T6 aluminum alloy and range upwardly in dimension from 7"×5". In the present description, outside dimensions of 9"×5¾" are assumed for the mast 14. The inner mast 16 has an O.D. of 2¼". The mast 14 is provided with an after chamber or cavity 18 which is roughly circular in cross-section and has an I.D. of 4¼", thus leaving a possible clearance of 1" between the inner mast 16 and the walls of cavity 18. At the rear of cavity 18 the mast walls form an aft-facing slot 20 having lips 22 and 24. As shown lip 22 is on the port side, lip 24, starboard. The width of the slot is 1⅛".

Figure 5:
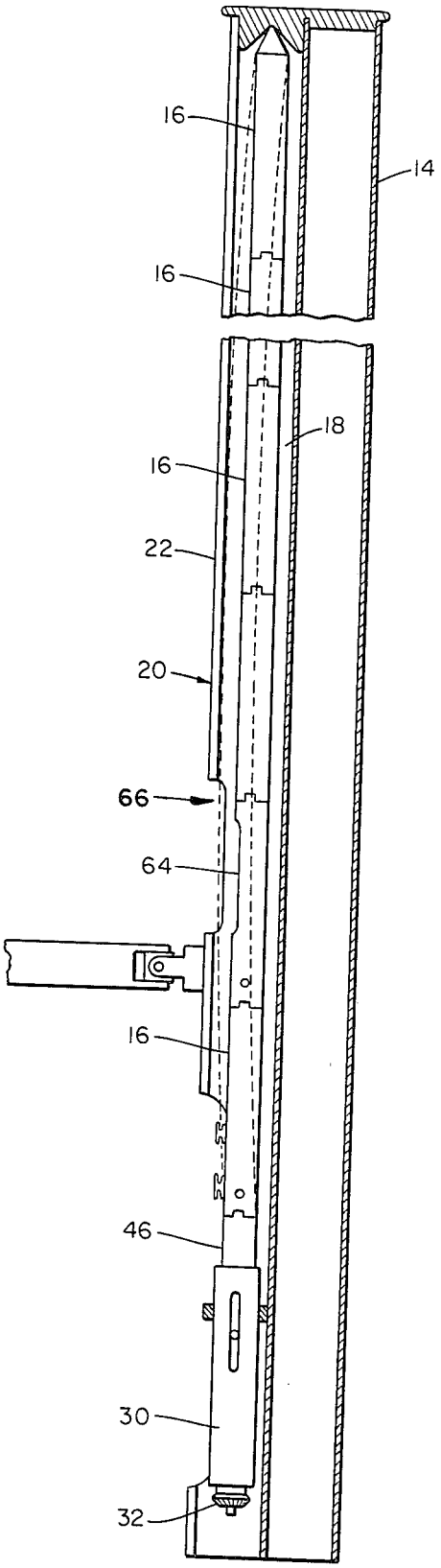
FIG. 5 is a cross-sectional view in side elevation showing the mast and inner mast.
Figure 6:
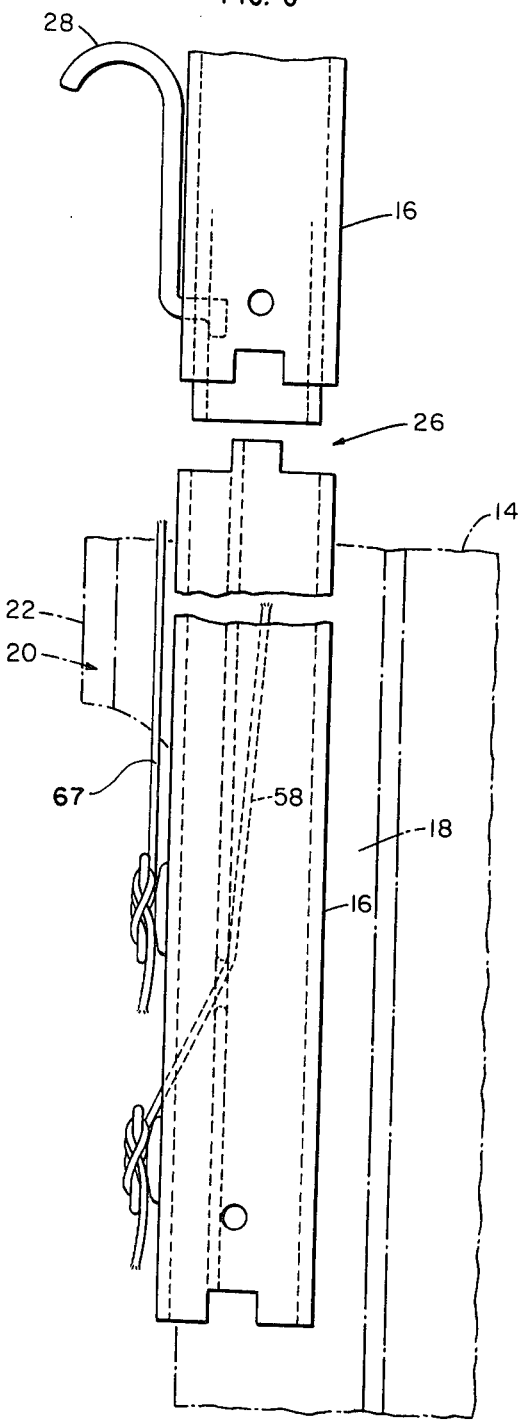
FIG. 6 is a view in side elevation showing the details of the inner mast section bayonnet joints.

Inner mast 16 may be a continuous tube or may be made up of sections (see FIGS. 4, 5, and 6), joined by a bayonnet joint indicated at 26 in FIG. 6. The advantage of making it in sections is to permit removal of the inner mast 16 without upstepping the mast 14 or requiring access to the top of the mast by use of a derrick or other mechanism.

The sectional form may be inserted section by section using a hooked tool 28 to lift the inserted sections high enough to permit another one to be inserted. At the base, a more permanently connected base section 30 (see FIG. 4) is provided to take the weight of the inner mast 14. Base section 30 is mounted on a bevel gear 32 which is in turn supported on thrust bearing 34. Gear 32 mates with bevel gear 36 which is driven by shaft 38 and crank 40. Rapid rotation is prevented by centrifugal brake means shown generally at 42 or by hand brake mechanism 44. Base section 30 houses a bottom section 46 of inner mast 16. Bottom section 46 carries a transverse pin 48 fitting in slot 50 of base section 30. In this way bottom section 46 is free to move vertically, but is fixed rotationally with respect to base member 30. A screw mechanism indicated generally at 52 is employed to make small adjustments in the vertical position of bottom section 46, and hence the vertical position of the inner mast 16 resting in it.

The top of inner mast 16 is provided with conical top 54 which fits into a conical matrix 56 at the top of mast 14. Thus, by using the vertical adjustment of screw member 52, the tube of the mast may be centered in the matrix 56. This provides an excellent maintenance free bearing surface for the top of inner mast 16, and completely eliminates the need for a swivel at the mast head.

The sail 12 may be bolted directly to the top of inner mast 16, or may be supported thereon by a halyard 58 which passes over a sheave 60 and is shackled to sail 12, at gromet 62. With this latter embodiment the advantage of centering the top of inner mast 16 by use of the mating conical sections 54 and 56 is that space is provided for the shackle and gromet 62 to swing around and not become lodged in slot 20. Halyard 58 and a downhaul 67 may be cleated to a lower section of the inner mast as shown in FIG. 6, below the goose-neck. When the sail is to be lowered, an additional length of halyard is tied onto the end of halyard 58, but in normal use, in order to facilitate rotating the mast while the sail is up, only a short portion of halyard is cleated. The remainder is removed and stored.

The luff of sail 12 is provided with a conventional small cable and pocket arrangement which permits the luff of the sail to be fed into a widened portion of slot 65 in inner mast 16 through a slot 66 in the mast above the goose-neck. Slot 65 is dimensioned in the usual manner to permit the sail to slide up and down but not come out. Slot 66 is dimensioned both to permit the sail to be fed to the inner mast in the usual manner and also to permit the sections of the inner mast to be fed in above the goose-neck if desired.

It will now be seen that the inner mast bears the full weight of the sail in compression. This is an important feature of the invention which will be broadly claimed. It permits the inner mast to rotate freely without causing any increase of resistance of the bearing surface at the top arising from increased pressure on the sail due to increased wind force.

Figure 8:
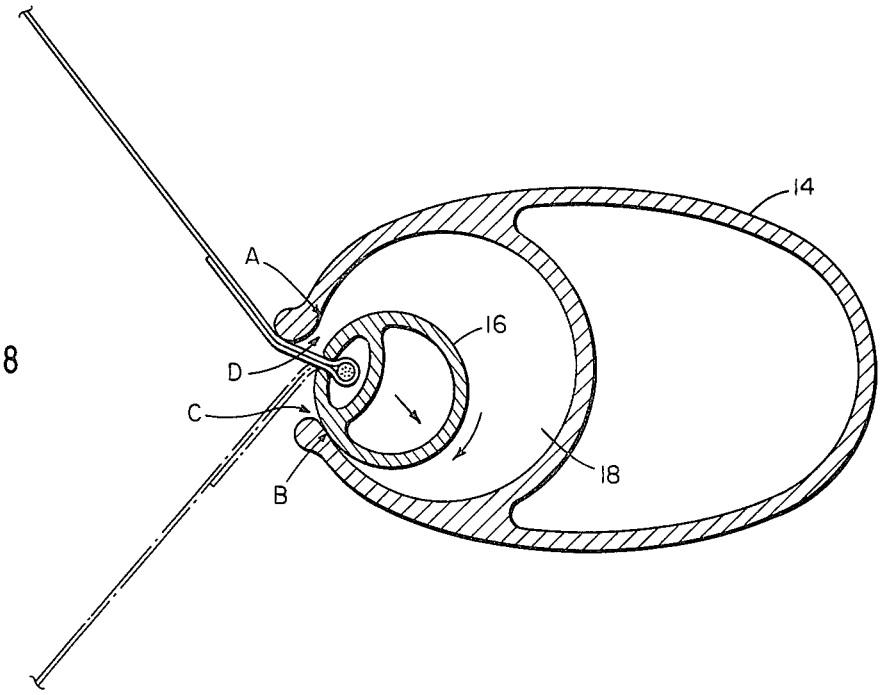
FIG. 8 is a plan view in cross-section of the mast and inner mast showing the pressure and friction points during furling and reefing.

While the top and bottom sections of inner mast 16 are normally centered in cavity 18, and inner mast 16 is essentially rigid both vertically and torsionally, inner mast 16 bends slightly to the rear (see dotted lines in FIG. 5) due to the pull of the sail at the middle height of mast 14. This is to be expected and the roach of the sail is cut to allow for it. When the inner mast 16 is in this latter position it contacts the inner surfaces of lips 22 and 24, as shown in FIG. 8. Since the inner mast 16 has an O.D. of $2\frac{1}{4}''$ and the slot 20 is $1\frac{1}{8}''$ wide, the contact point between inner mast 16 and the walls is at a low angle which becomes an expanded area when said cloth is wound up on the inner mast. In addition lip 22 is faired so as to avoid a sharp bend in the sail and the resistance such a bend creates. Lip 24 does not normally contact the sail when inner mast 16 is up against slot 20. Therefore lip 24 is not faired as much as lip 22, although lip 24 has a slight fairing indicated at the letter C in FIG. 8 to permit the bump in the sail caused by the first bend therein to slide smoothly over lip 24 while unfurling.

When the sail 12 is completely unfurled, and inner mast 16 is lodged against slot 20, it contacts lip 22 on the starboard tack, but on the port tack the sail draws directly from slot 65 of inner mast 16. When the sail 12 is reefed or furled, it still contacts lip 22 on the starboard tack, while on the port tack the sail draws from the tangent of inner mast 16 (plus sail cloth thereon), and does not contact lip 24, except when running before the wind.

During furling or reefing the turning action of the inner mast 16 and the pressure at point B in FIG. 8 tends to cause the inner mast to move in the direction of the center arrow, i.e. away from point A. In this way pressure against access of the sail to cavity 18 at point A is somewhat relieved by the turning action. The converse occurs on unfurling during which the inner mast tends to ride up only at point A where it is relatively free to slide back.

Since slot 20 is $1\frac{1}{8}''$ wide it can easily accommodate wrinkles in the sail. The thickness of sail cloth runs from about 0.010" to over 0.025", and perhaps 0.050" at the seam. This overlapping and bending even at the seam can give a thickness of about $\frac{1}{4}''$. Such a thickness presented a serious problem in the prior art, but is readily accommodated in the present invention. Accordingly, there is no need with the present invention to cut the sail flat. A normal roach can be employed. In addition, since the peak and foot ends of the inner mast 16 are centered, while the mid portions bend aft, the build-up of the sail on inner mast 16 causes the mast to straighten, thereby removing some of the fullness of the sail in the middle area. This is an advantage because it permits flattening of the sail while furling (at a time when flattening is usually desired). This flattening can be accentuated by tapering the inner mast sections or by applying thereto enlargening sleeves so as to give the middle sections of the inner mast 12 a larger diameter to varying degrees depending upon the location of the fullness of the sail.

It will be noted also that the most critical area for the build up of sail material on the inner mast 16 is in the tack area of the sail where more sail material must be housed in cavity 18. However, since the lower-most sections of inner mast 16 are centered at the bottom, a maximum of space and a minimum of pressure against the walls of slot 20 are provided in that area.

It will also be noted that the furling and reefing arrangement herein described permits the initial rigging of the boat to be designed for maximum performance in very light air such that even in moderate winds, one can expect to sail in a partly furled condition. Further, it permits rapid reefing and unreefing in fluky wind to prevent excessive heeling during a temporary puff of wind.

Having thus disclosed a preferred embodiment of the invention, I claim:

1. Apparatus for supporting and housing a sail comprising a substantially vertical stayed mast, walls forming a chamber in said mast and a rear facing slot leading from the outside into said chamber, a hollow cylindrical member in said chamber having an outside diameter greater than the width of said slot, means connecting said sail to said cylindrical member and supporting the entire weight of said sail, means for rotating said cylindrical member whereby the sail is drawn into said chamber to furl said sail, said cylindrical member being substantially rigid, extending in said chamber the full vertical length of said sail, means supporting the weight of said cylindrical member against downward forces applied thereto by said cylindrical member and the weight of said sail only at the base of said cylindrical member independently of said mast, and means at the top of said chamber for supporting said cylindrical member only against forces applied laterally thereto.

2. The apparatus defined in claim 1 further characterized by said cylindrical member comprising interlocking sections fixed against rotation therebetween.

3. The apparatus defined in claim 2 further characterized by walls forming a sail holding slot in said interlocking sections.

4. The apparatus defined in claim 1 further characterized by said means at the top of said chamber comprising a recess and the top of said cylindrical member fitting therein when said sail is in the fully hoisted position.

5. The apparatus defined in claim 4 further characterized by the axis of said recess being positioned substantially forward of said slot whereby the top of said cylindrical member is held substantially forward of said slot when it is fully lodged in said recess.

6. The apparatus defined in claim 1 further characterized by walls forming a sail holding slot in said cylindrical member.

7. The apparatus defined in claim 6 further characterized by a halyard, a halyard sheave at the top of said cylindrical member and means for sliding said sail longitudinally of said cylindrical member, whereby said sail can be hoisted up and down in the conventional manner while in the unfurled condition.

* * * * *